US009554615B2

(12) United States Patent
Labonte

(10) Patent No.: US 9,554,615 B2
(45) Date of Patent: Jan. 31, 2017

(54) SKATE BOOT HAVING A TOE CAP WITH REAR EXTENSIONS

(71) Applicant: BAUER HOCKEY CORP., St-Jerome (CA)

(72) Inventor: Ivan Labonte, Montreal (CA)

(73) Assignee: BAUER HOCKEY, INC., Exeter, NH (US)

( * ) Notice: Subject to any disclaimer, the term of this patent is extended or adjusted under 35 U.S.C. 154(b) by 139 days.

(21) Appl. No.: 14/087,092

(22) Filed: Nov. 22, 2013

(65) Prior Publication Data

US 2014/0259794 A1 Sep. 18, 2014

Related U.S. Application Data

(60) Provisional application No. 61/792,721, filed on Mar. 15, 2013.

(51) Int. Cl.
*A43B 5/16* (2006.01)
*A43B 23/08* (2006.01)

(52) U.S. Cl.
CPC ..... *A43B 5/16* (2013.01); *A43B 5/1683* (2013.01); *A43B 23/087* (2013.01)

(58) Field of Classification Search
CPC ..... A43B 5/16; A43B 5/1683; A43B 23/081; A43B 23/086; A43B 23/087
USPC ..... 36/115, 77 R
See application file for complete search history.

(56) References Cited

U.S. PATENT DOCUMENTS

| | | | | |
|---|---|---|---|---|
| 3,668,793 | A * | 6/1972 | Stohr et al. | 36/71 |
| 4,351,537 | A | 9/1982 | Seidel | |
| 5,171,033 | A * | 12/1992 | Olson et al. | 280/11.202 |
| 5,210,963 | A * | 5/1993 | Harwood | 36/77 R |
| 5,342,070 | A * | 8/1994 | Miller et al. | 280/11.231 |
| 5,397,141 | A * | 3/1995 | Hoshizaki et al. | 280/11.3 |
| 5,596,820 | A * | 1/1997 | Edauw et al. | 36/115 |
| 5,768,807 | A * | 6/1998 | Caeran et al. | 36/115 |
| 5,839,736 | A * | 11/1998 | Chiu et al. | 280/11.221 |
| 5,913,526 | A * | 6/1999 | Olson et al. | 280/11.231 |
| 5,926,979 | A * | 7/1999 | Borel | 36/115 |
| 6,105,280 | A * | 8/2000 | Marcolin | 36/117.1 |
| 6,148,546 | A * | 11/2000 | Demarchi | 36/115 |
| 6,371,494 | B1 * | 4/2002 | Bonaventure et al. | 280/11.19 |
| 6,374,516 | B1 * | 4/2002 | Bonaventure et al. | 36/115 |
| 8,387,286 | B2 * | 3/2013 | Koyess et al. | 36/115 |
| 2004/0016150 | A1 * | 1/2004 | Labonte et al. | 36/115 |
| 2005/0144809 | A1 * | 7/2005 | Yang | 36/77 R |
| 2005/0217146 | A1 * | 10/2005 | Jones et al. | 36/54 |
| 2006/0053662 | A1 * | 3/2006 | Yang | 36/115 |
| 2010/0156058 | A1 * | 6/2010 | Koyess et al. | 280/11.12 |
| 2011/0101665 | A1 * | 5/2011 | Van Horne et al. | 280/841 |

(Continued)

FOREIGN PATENT DOCUMENTS

| | | |
|---|---|---|
| CA | 2726580 | 6/2012 |
| CH | 658795 | 12/1986 |

*Primary Examiner* — Khoa Huynh
*Assistant Examiner* — Megan Brandon

(57) ABSTRACT

A skate boot having an outer shell and a toe cap. The outer shell has medial and lateral side portions having front medial and lateral end portions. The toe cap has rear medial and lateral extensions defining medial and lateral hollow spaces. The front medial and lateral side end portions of the outer shell are at least partially received in the medial and lateral hollow spaces of the toe cap for affixing the toe cap to the outer shell.

18 Claims, 11 Drawing Sheets

(56) References Cited

U.S. PATENT DOCUMENTS

| | | | | |
|---|---|---|---|---|
| 2012/0011742 | A1* | 1/2012 | Yang | 36/45 |
| 2012/0167418 | A1* | 7/2012 | Frappier | 36/115 |
| 2012/0204452 | A1* | 8/2012 | Van Horne et al. | 36/115 |

* cited by examiner

SKATE BOOT HAVING A TOE CAP WITH REAR EXTENSIONS

CROSS-REFERENCE TO RELATED APPLICATION

This application claims the benefit under 35 USC §119(e) of U.S. Provisional Application 61/792,721 filed on Mar. 15, 2013, the contents of which are incorporated herein by reference in their entirety.

FIELD OF THE INVENTION

The present invention relates to a skate boot having an outer shell and a toe cap. The outer shell has medial and lateral side portions having front medial and lateral end portions. The toe cap has rear medial and lateral extensions defining medial and lateral hollow spaces. The front medial and lateral side end portions of the outer shell are at least partially received in the medial and lateral hollow spaces of the toe cap for affixing the toe cap to the outer shell.

BACKGROUND OF THE INVENTION

Skate boots are well known in the art for use in hockey skates, figure skates or roller skates, for example. Conventionally, the skate boot has medial and lateral quarters (side portions) for at least covering the medial and lateral sides of the skater's foot, the medial and lateral quarters having front medial and lateral end portions located generally near the proximal joints of the big and little toes. In order to protect the toes, the boot also comprises a toe cap made of a rigid material and at least partially covering the skater's toes. The toe cap may comprise a generally planar bottom contacting or anchoring portion conforming to the front lower surface of the insole and a pair of tabs or side edges extending inwardly from the bottom portion of the toe cap. The bottom portion may extend over the entire frontal area of the insole but may alternatively only extend along the edge of the insole leaving the center portion of the insole uncovered. The toe cap also comprises a toe portion for at least partially surrounding the skater's toes, an upper portion for at least partially overlapping the skater's toes and medial and lateral sides extending rearwardly for affixing the toe cap to the front medial and lateral end portions of the boot via glue and/or stitches. The boot also usually comprises medial and lateral overlays for protecting the stitches and/or connecting portions between the front medial and lateral end side portions of the boot and the medial and lateral rear sides of the toe cap. The medial and lateral overlays may be made of a rigid material as fabric, textile, leather, synthetic leather, nylon, etc. and the medial and lateral overlays are usually glued and/or stitched over the front medial and lateral end side portions of the boot.

Not only does the addition of the medial and lateral overlays require further manufacturing steps, but these medial and lateral overlays also add weight to the skate boot construction.

Accordingly, there is a need in the industry for an improved skate boot construction which overcomes the aforementioned problems and which can offer a toe cap affixable to the medial and lateral end side portions of the skate boot without requiring further manufacturing steps and/or additional components to be mounted to the skate boot.

SUMMARY OF THE INVENTION

In accordance with an aspect, the invention provides a skate boot for receiving a skater's foot, the skate boot comprising: (i) an outer shell having medial and lateral side portions for facing the medial and lateral sides of the skater's foot, the medial and lateral side portions having front medial and lateral end portions; and (ii) a toe cap for protecting the skater's toes, the toe cap comprising a bottom portion, a toe portion for at least partially surrounding the skater's toes, an upper portion for at least partially overlapping the skater's toes and rear medial and lateral extensions extending rearwardly from the toe portion, the rear medial extension defining a medial hollow space and the rear lateral extension defining a lateral hollow space, the front medial and lateral end portions of the medial and lateral side portions of the outer shell being at least partially received in the medial and lateral hollow spaces of the rear medial and lateral extensions of the toe cap for affixing the toe cap to the outer shell.

These and other aspects and features of the present invention will now become apparent to those of ordinary skill in the art upon review of the following description of specific embodiments of the invention in conjunction with the accompanying drawings.

BRIEF DESCRIPTION OF THE DRAWINGS

A detailed description of examples of embodiments of the present invention is provided hereinbelow with reference to the following drawings, in which.

Figure 1:
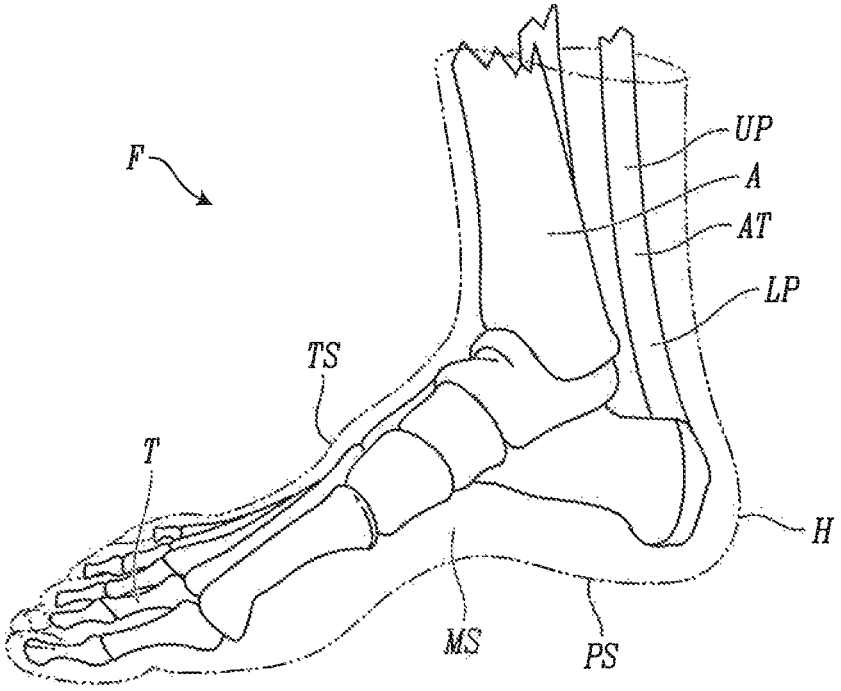
FIG. 1 is a side view of a right human foot with the integument of the foot shown in dotted lines and the bones shown in solid lines.

In the drawings, embodiments of the invention are illustrated by way of example. It is to be expressly understood that the description and drawings are only for the purposes of illustration and as an aid to understanding, and are not intended to be a definition of the limits of the invention.

DETAILED DESCRIPTION OF THE EMBODIMENTS

To facilitate the description, any reference numerals designating an element in one figure will designate the same element if used in any other figures. In describing the embodiments, specific terminology is resorted to for the sake of clarity but the invention is not intended to be limited to the specific terms so selected, and it is understood that each specific term comprises all equivalents. Unless otherwise indicated, the drawings are intended to be read together with the specification, and are to be considered a portion of the entire written description of this invention. As used in the following description, the terms "horizontal", "vertical", "left", "right", "up", "down" and the like, as well as adjectival and adverbial derivatives thereof (e.g., "horizontally", "rightwardly", "upwardly", "radially", etc.), simply refer to the orientation of the illustrated structure. Similarly, the terms "inwardly," "outwardly" and "radially" generally refer to the orientation of a surface relative to its axis of elongation, or axis of rotation, as appropriate.

Figure 2:
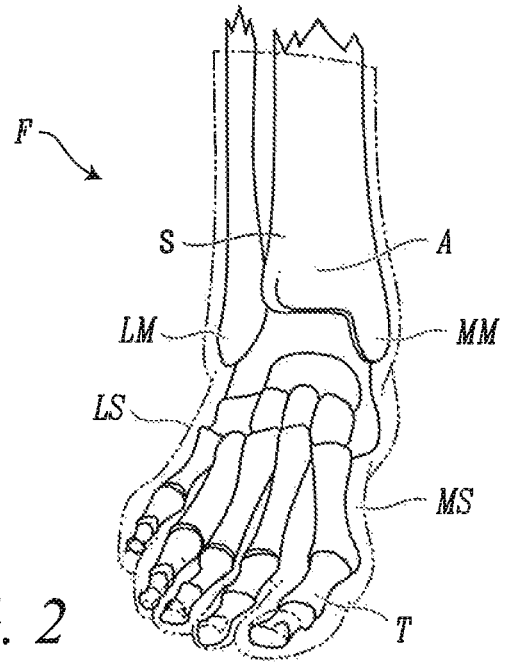
FIG. 2 is a front view of the human foot of FIG. 1.

Shown in FIGS. 1 and 2 is a typical right human foot F that includes toes T, a plantar surface PS, a top surface TS, a medial side MS and a lateral side LS. In addition, the human foot includes a heel H, an Achilles tendon AT and an ankle A having a lateral malleolus LM and a medial malleolus MM, the lateral malleolus LM being at a lower position than the medial malleolus MM. The Achilles tendon AT has an upper part UP and a lower part LP projecting outwardly with relation to the upper part UP, the lower part merging with the heel H.

Figure 3:
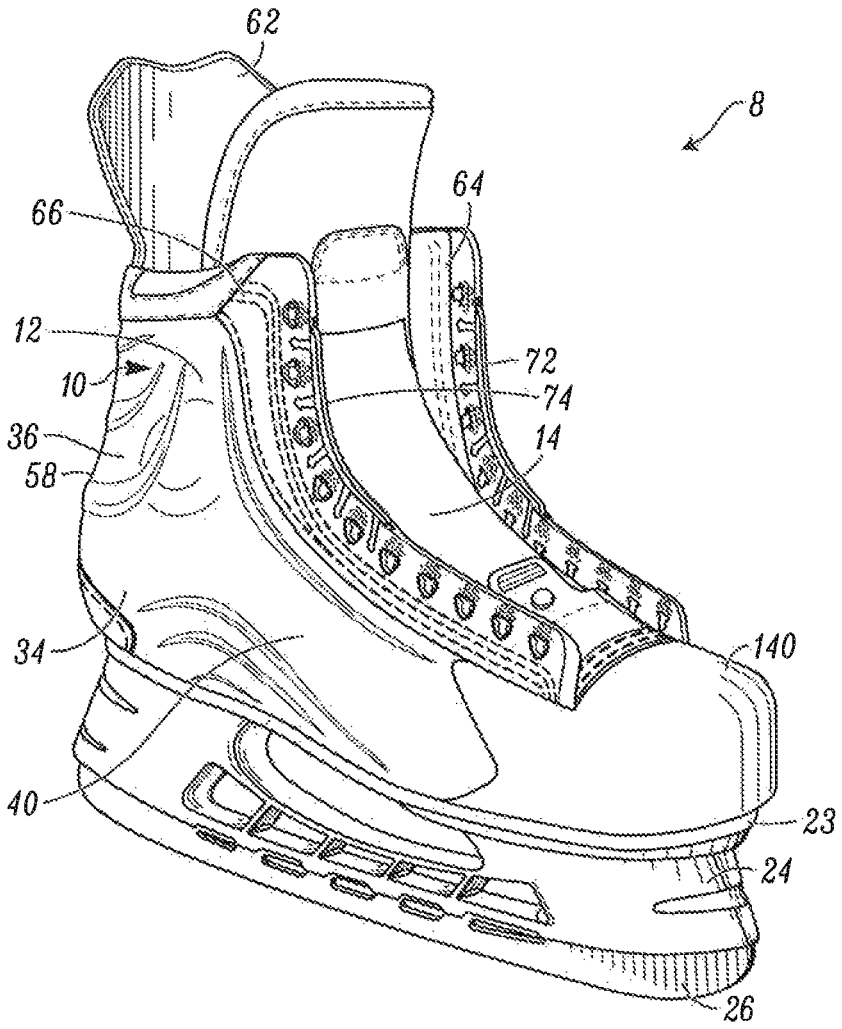
FIG. 3 is a perspective view of an ice skate in accordance with the present invention.
Figure 4:
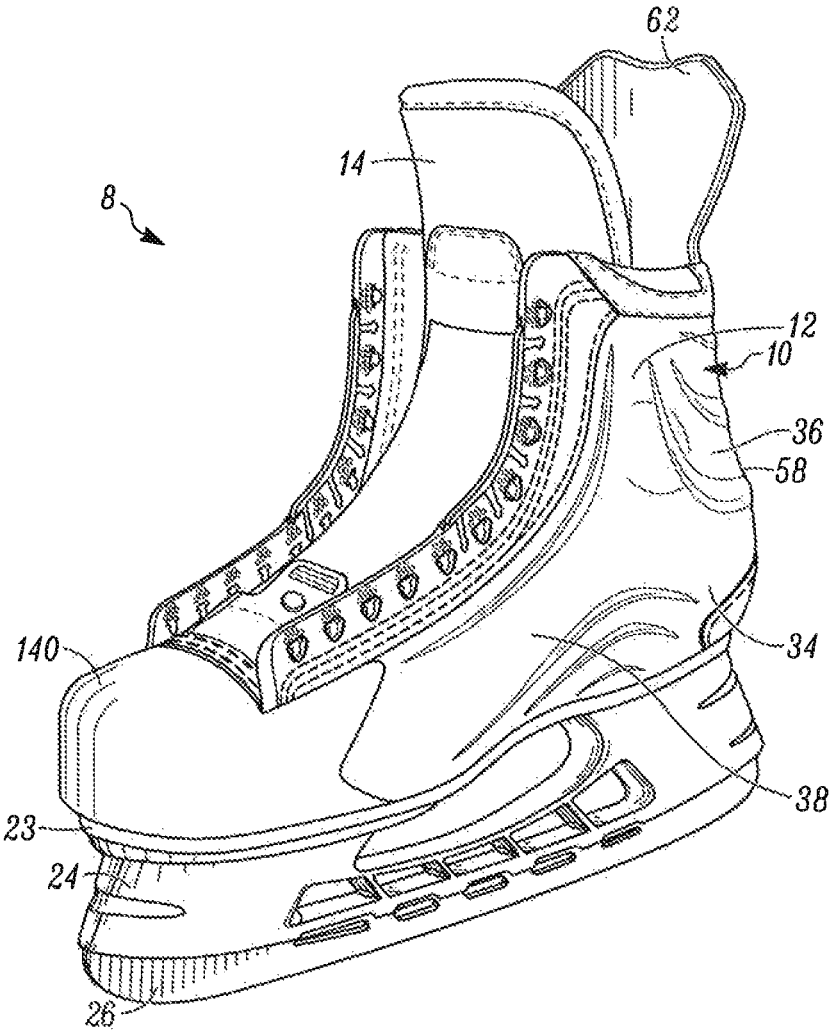
FIG. 4 is a second perspective view of the ice skate of FIG. 3.
Figure 5:
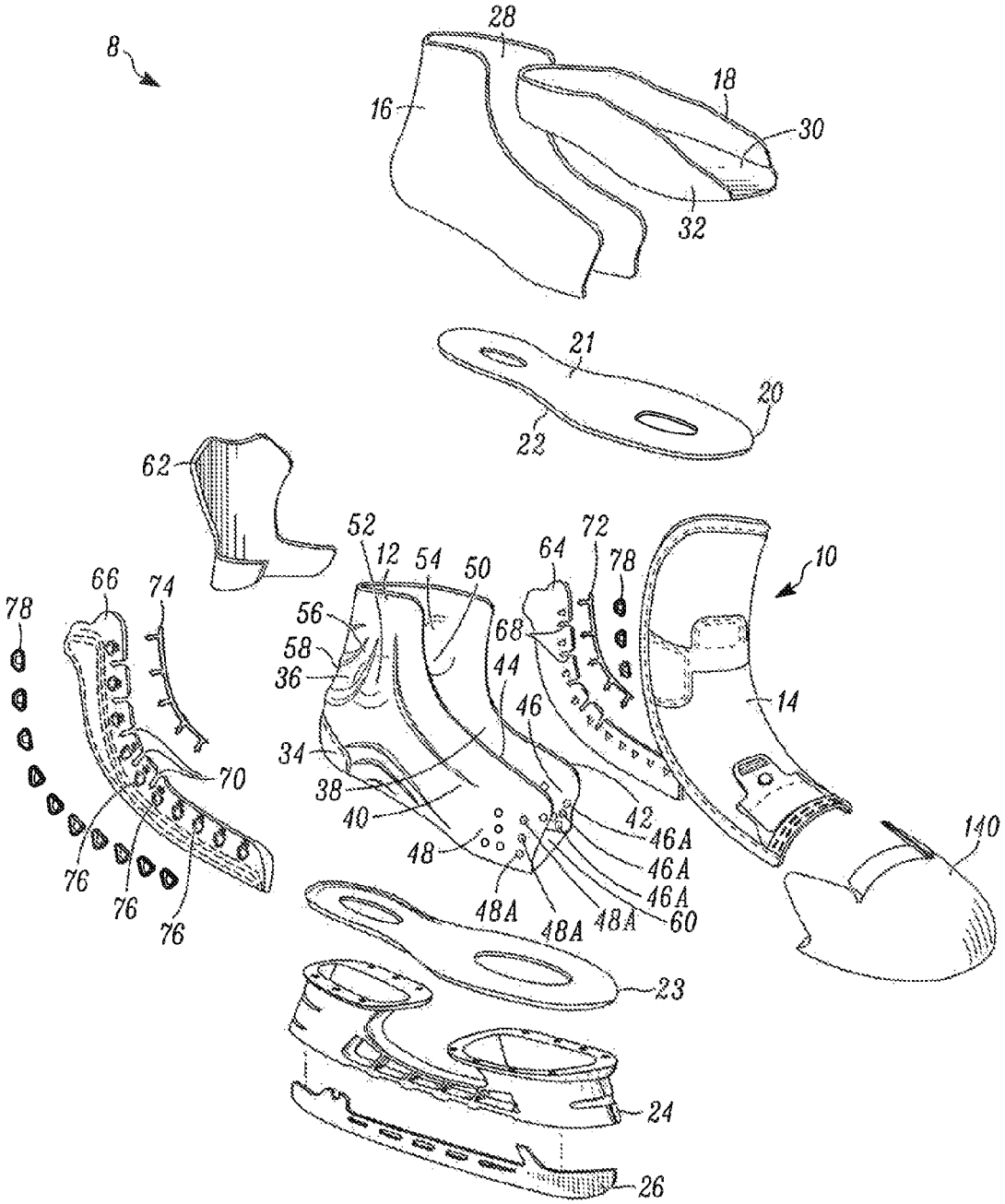
FIG. 5 is an exploded perspective view of the ice skate of FIG. 3.
Figure 8:
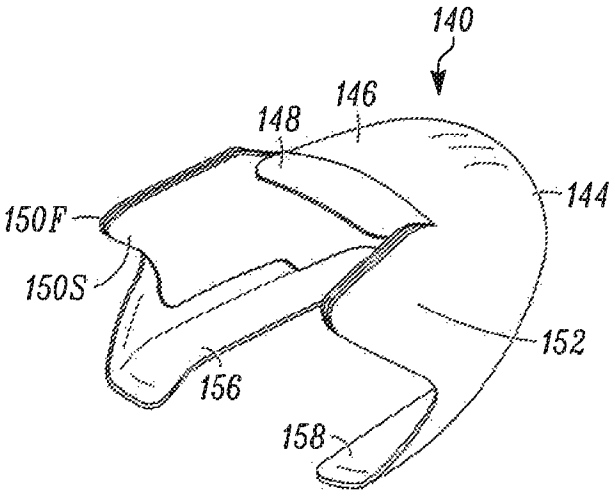
FIG. 8 is a rear top perspective view of the toe cap of FIG. 6.
Figure 6:
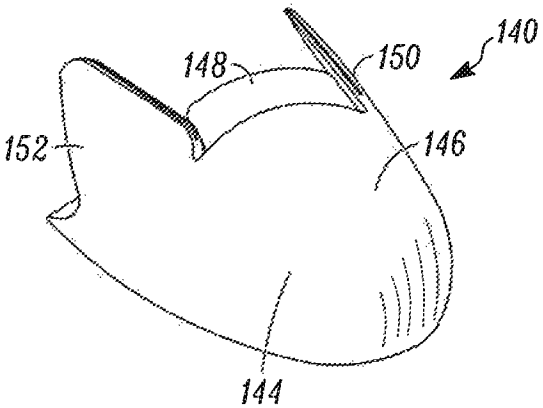
FIG. 6 shows a front top perspective view of a toe cap in accordance with the present invention.

Shown in FIGS. 3 to 5 is an ice skate 8 that comprises a skate boot 10 suitable for enclosing the foot of a skater. Although the skate boot 10 shown in the figures is being used for an ice skate 8, it is understood that the skate boot 10 can be used for a roller skate.

The skate boot 10 has an outer shell 12 for receiving the skater's foot, a toe cap 140 for protecting the skater's toes, a tongue 14 extending upwardly and rearwardly from the toe cap 140 for covering a forefoot of the skater's foot, an inner lining 16, a footbed 18, an insole 20, an outsole 23, an ice skate blade holder 24 and a blade 26.

The outer shell 12 may be made of a thermoformable material. As used herein, the expression "thermoformable material" refers to a material that is capable of softening when heated and of hardening again when cooled. Some non-limiting examples of different types of thermoformable material comprise ethylene vinyl acetate (EVA) foam, polyethylene foam, polystyrene foam and polypropylene foam.

The outer shell 12 is thermoformed such that it comprises a heel portion 34 for receiving the heel, an ankle portion 36 for receiving the ankle and medial and lateral side portions 38, 40 for facing the sides of the skater's foot. These components form a foot receiving cavity that conforms to the general shape of the skater's foot. The heel portion 34 may be thermoformed such that it is substantially cup-shaped for following the contour of the heel.

The inner lining 16 is affixed (e.g. glued and/or stitched) to an inner surface of the outer shell 12 and it comprises an inner surface 28 for contacting with the heel, ankle and medial and lateral sides of the skater's foot in use.

The inner liner 16 may be made of different layers, for example an inner layer that is made of an air-pervious fabric and has an inner surface to contact the player's foot or sock in use, an intermediate cushioning layer made of a resilient cushioning material, and an outer layer that is co-extensive with the inner layer and cushioning layer and that is made of a water impervious material. The air-pervious fabric may be made of nylon fabric. The resilient cushioning material may be made vinyl foam.

In other examples, the inner liner 16 may be made of one or more layers of materials such as: anti-microbial, anti-fungal polypropylene, polyester or polyester blend having a polyester or cotton backing or the like; fabric or nonwoven made from corn fibers or a blend of corn fibers with acetate, polyvinyl acetate or polyester fibers; synthetic leathers; polyester fabrics; nonwoven fabrics, nonwoven wool blend; polyester fabric with an active carbon compound bonded to the polyester; or sanded polyester microfiber material.

In another example, the inner liner 16 may be made of a layer of soft material such as a sheet of polyester laminated with a layer of foam, or of a layer of fabric made from nylon fibers. The inner liner 16 may also be made of brushed nylon fabric, nylon mesh, polyester mesh or synthetic leather.

If the skate boot 10 comprises a rigid insert for providing more rigidity in the ankle region of the boot, such rigid insert is sandwiched between the outer shell 12 and inner lining 16 and such inner lining 16 may be glued to the inner surfaces of the outer shell 12 and rigid insert and stitched along its periphery to the outer shell 12.

The footbed 18 is designed to be mounted inside the outer shell 12 and it comprises an upper surface 30 for receiving the plantar surface of the skater's foot and a peripheral wall 32 projecting upwardly from the upper surface 30. The peripheral wall 32 partially cups the heel of the skater's foot and extends up to a medial line of the skater's foot for partially covering the medial and lateral sides of the skater's foot.

The insole 20 has an upper surface 21 for at least partially facing the plantar surface of the skater's foot and a lower surface 22 on which bottom walls of the toe cap 140 and the outsole 23 may be affixed for forming the skate boot. In another embodiment, the outer shell may rather comprise an insole that is integrally formed with the outer shell.

The ankle portion 36 of the outer shell 12 comprises medial and lateral ankle sides 50, 52. The medial ankle side 50 has a medial cup-shaped depression 54 for receiving the medial malleolus and the lateral ankle side 52 has a lateral cup-shaped depression 56 for receiving the lateral malleolus. The lateral depression 56 is located slightly lower than the medial depression 54, for conforming to the morphology of the skater's foot. The ankle portion 36 further comprises a rear portion 58 that may be thermoformed such that it follows the lower part of the Achilles tendon of the skater's foot.

The medial and lateral side portions 38, 40 of the outer shell 12 comprise respective upper edges 42, 44 and extend forwardly from the heel and ankle portions 34, 36 for facing the medial and lateral sides of the skater's foot respectively up to front medial and lateral end portions 46, 48, which, in use, are located generally near the proximal joints of the big and little toes of the skater's foot for facing the proximal regions adjacent the toes of the skater's foot.

As best shown in FIG. 5, the front medial and lateral end portions 46, 48 of the outer shell 12 each have a plurality of apertures 46A, 48A.

The skate boot 10 also comprises a tendon guard 62 for facing at least partially the upper part of the Achilles tendon of the skater's foot. The tendon guard 62 allows backwards flexion of the ankle when the foot moves towards full extension. The tendon guard 62 may be made of silicone or may be made by injection molding using polyester, polyurethane, polyamide, or other suitable thermoplastics. The selected material may have enough flexibility to allow the tendon guard 62 to flex rearwardly when pressure is applied on it while it should also have enough resiliency to allow the tendon guard 62 to return to its initial position when pressure is no longer applied on it.

The skate boot 10 also comprises medial and lateral lace members 64, 66 with medial and lateral openings 68, 70 for receiving medial and lateral inserts 72, 74. The lace members 64, 66 may be made of fabric, textile, leather or plastic and comprise apertures 76 for receiving laces. Eyelets 78 may be punched into the apertures 76 of the medial and lateral lace members 64, 66 in order to provide more rigidity.

The lace members 64, 66 can be mounted to the upper edges 42, 44 of the medial or lateral side portions 38, 40 of the outer shell 12 via any method known in the art such as stitching, overmolding, thermal bonding, high-frequency welding, vibration welding, piping, adhesive, or any combination thereof. In another embodiment, the lace members 64, 66 may be omitted and the outer shell may rather comprise lace openings and eyelets provided in the upper edge region of the medial and lateral side portions.

Referring to FIGS. 6 to 18, the toe cap 140 comprises a bottom portion 142 for at least partially covering the front portion of the bottom surface 22 of the insole 20, a toe portion 144 for at least partially surrounding the skater's toes, an upper portion 146 for at least partially overlapping the skater's toes, a top extension 148 for affixing the tongue 14 to the toe cap 140, and rear medial and lateral extensions 150, 152 extending rearwardly from the toe portion 144. The outer surfaces of the rear medial extension 152 and of the rear lateral extension 152 may comprise embossed patterns, ridges or protrusions resulting in a non-smooth outer surface or any other pattern for creating a visual appearance that may resemble the appearance of a skate boot having a traditional overlay for covering the junction of the front medial and lateral ends and toe cap. The top extension 148 of the toe cap 140 may be glued and/or stitched to the distal end portion of the tongue 14 in order to affix the tongue 14 to the toe cap 140. The distal end portion of the tongue may also define a cavity for at least partially receiving the top extension 148 of the toe cap 140.

The bottom portion 142 of the toe cap 140 may comprise front, medial and lateral bottom walls 154, 156, 158 extending inwardly from the toe portion 144 and rear medial and lateral extensions 150, 152 extending rearwardly from the toe portion 144. In some cases, the bottom portion 142 may be shorter than illustrated in FIGS. 6 to 20, i.e. not extending rearwards as much, while in other cases the bottom portion 142 may be longer, i.e. extending further rearwards.

The rear medial extension 150 defines a medial hollow space for at least partially receiving the medial end portion 46 of the medial side portion 38 of outer shell 12 and the rear lateral extension 152 defines a lateral hollow space for at least partially receiving the lateral end portion 48 of lateral side portion 40 of the outer shell 12 for affixing the toe cap 140 to the outer shell 12.

Figure 7:
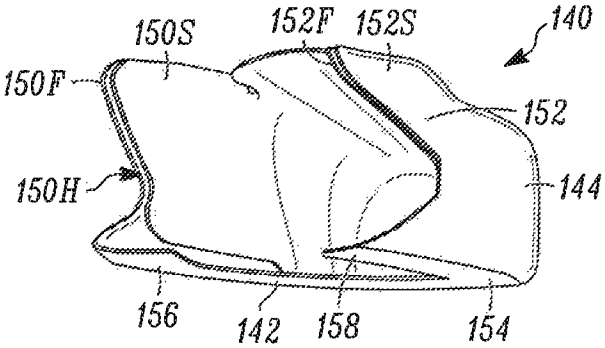
FIG. 7 is a rear bottom perspective view of the toe cap of FIG. 6.
Figure 10:
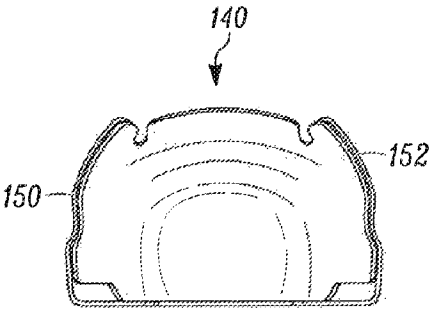
FIG. 10 is a rear elevational view of the toe cap of FIG. 6.
Figure 11:
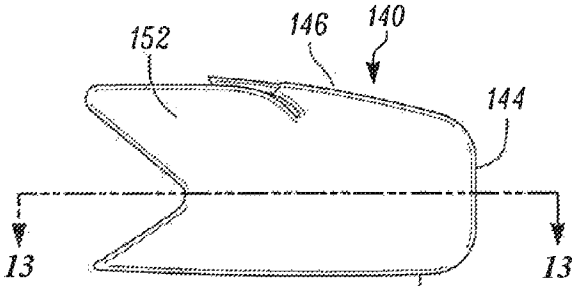
FIG. 11 is a side elevational view of the toe cap of FIG. 6.
Figure 12:
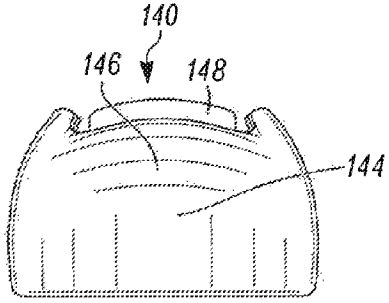
FIG. 12 is a front elevational view of the toe cap of FIG. 6.
Figure 13:
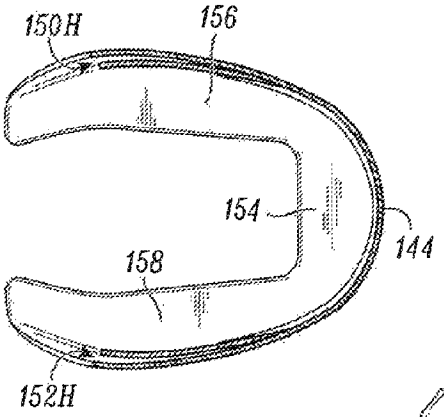
FIG. 13 is a cross-sectional view taken along line 13-13 in FIG. 11.
Figure 9:
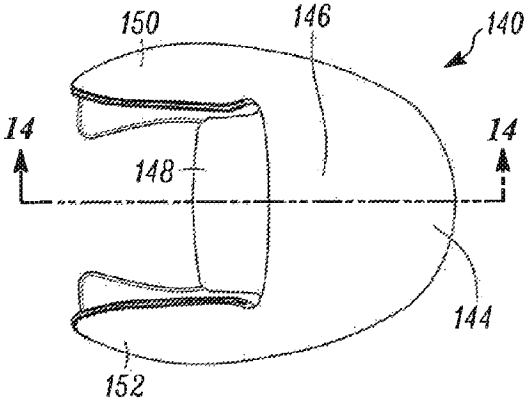
FIG. 9 is a top view of the toe cap of FIG. 6.
Figure 14:
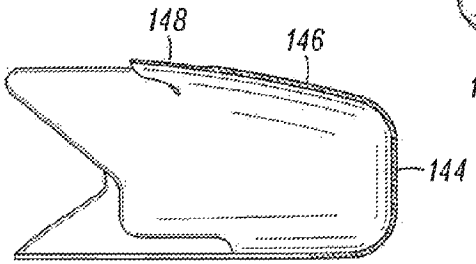
FIG. 14 is a cross-sectional view taken along line 14-14 in FIG. 9.
Figure 15:
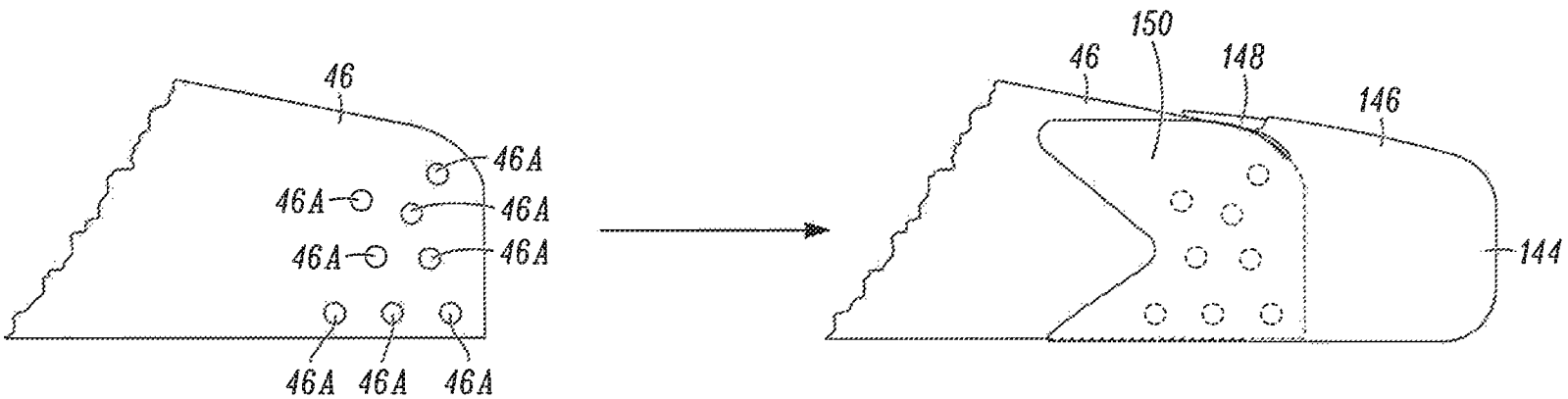
FIG. 15 shows the assembly of the front lateral end portion of the side portion of the outer shell into the rear lateral extension of the toe cap.
Figure 16:
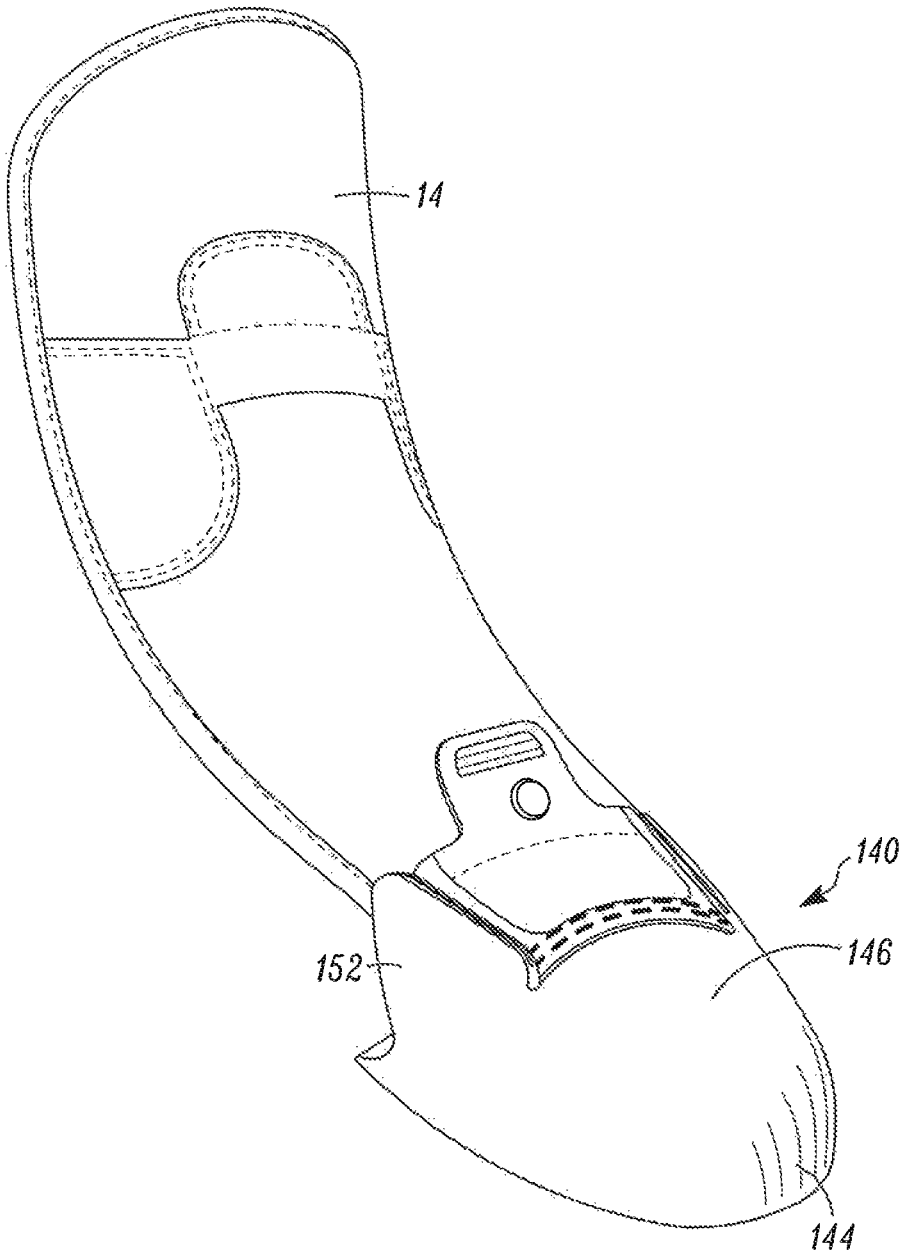
FIG. 16 is a top perspective view of the toe cap affixed to the tongue.
Figure 17:
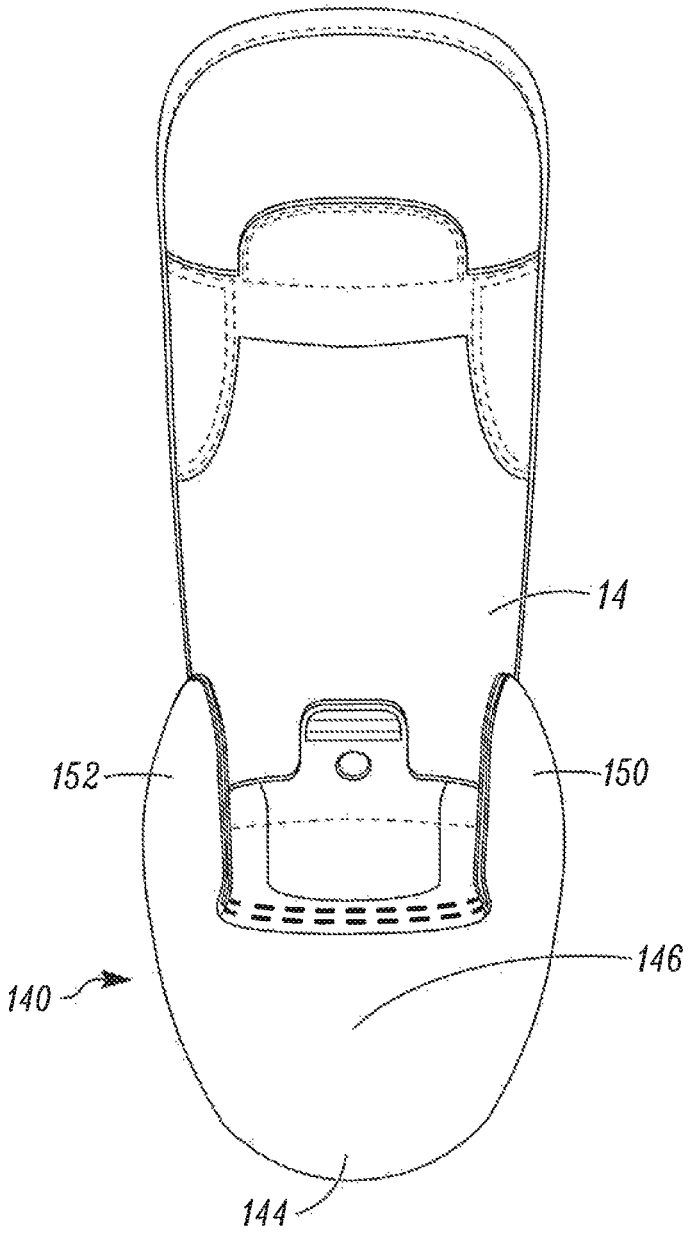
FIG. 17 is a top view of the toe cap and tongue of FIG. 16.
Figure 18:
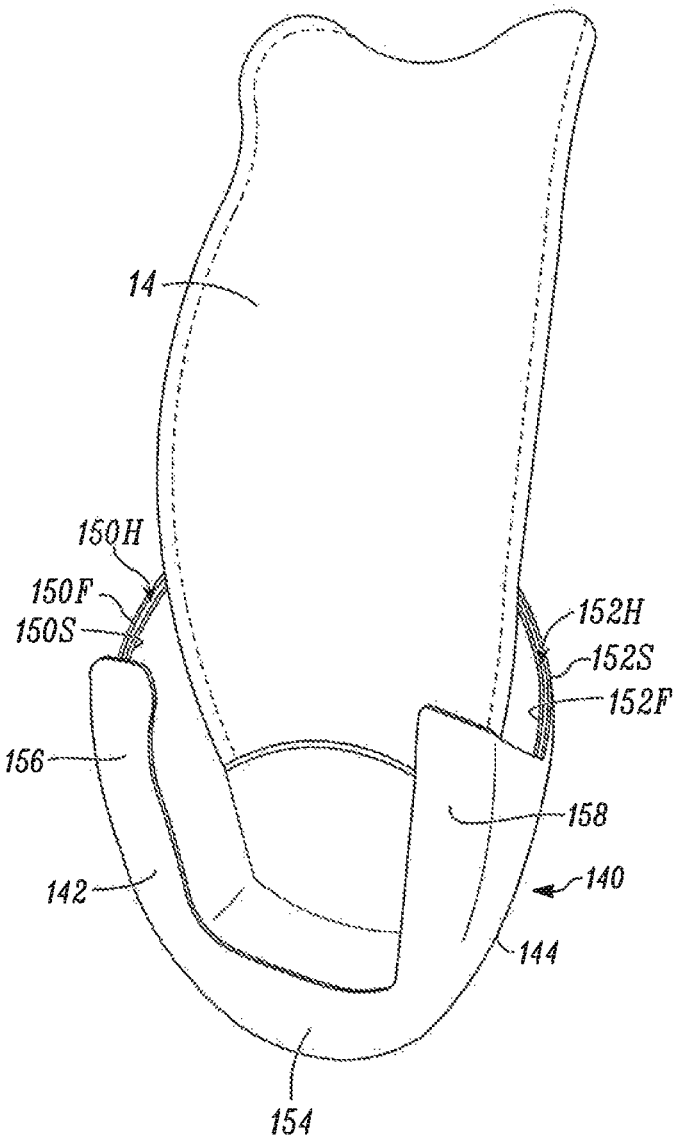
FIG. 18 is a bottom perspective view of the toe cap and tongue of FIG. 16.
Figure 19:
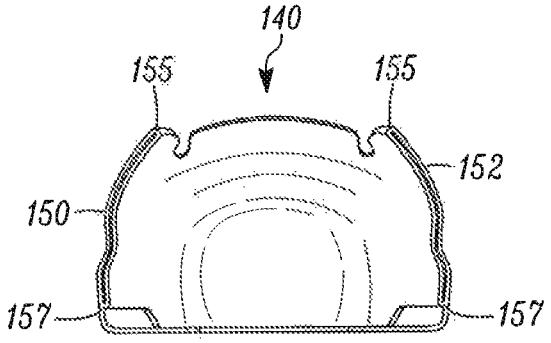

For example, as best seen in FIGS. 7, 13 and 18, the rear medial extension 150 may comprise first and second medial walls 150F, 150S defining therebetween a medial hollow space 150H and the rear lateral extension 152 may comprise first and second lateral walls 152F, 152S defining therebetween a lateral hollow space 152H.

In another embodiment, each of the rear medial and lateral extensions of the toe cap may also comprise a top wall 155 and a bottom wall 157 for defining a rectangular hollow space (cavity) surrounded by the top and bottom walls and the first and second (side) walls. The medial and lateral cavities (hollow spaces) are adapted to at least partially receive the medial end portion 46 of the medial side portion 38 and the lateral end portion 48 of lateral side portion 40 for affixing the toe cap to the outer shell 12. Each of the hollow space of the rear medial and lateral extensions of the toe cap may thus be a cavity facing rearwards towards the outer shell 12. It is understood that the medial and lateral cavities are designed to receive the medial and lateral end portions 46, 48, which are of shape and size allowing for a registering within the cavities.

In yet another embodiment, the rear medial extension and the rear lateral extension of the toe cap may comprise a specific shape or configuration designed to mate with a matching shape or configuration of the medial or lateral end portions of the outer shell. For example, the rear medial extension and the rear lateral extension of the toe cap may further comprise a generally horizontal wall extending between the first and second (side) walls for defining an H-shaped configuration comprising two side walls being joined together by the horizontal wall. In such an instance, each of the medial and lateral end portions of the outer shell has a matching configuration comprising a groove or slit of a size allowing for a mating fit with the horizontal wall. In this latter embodiment, the hollow space comprise upper and lower hollow spaces with a horizontal wall extending between the first and second (side) walls.

It is understood that the medial end portion 46 of the medial side portion 38 and the lateral end portion 48 of lateral side portion 40 may be retained in the medial hollow space 150H and lateral hollow space 152H by any suitable mechanical affixing means (e.g. snap in, press fit, mating fit, etc.) in order to affix the toe cap 140 to the outer shell 12.

In one embodiment, the first and second walls of the rear medial and lateral extensions 150, 152 of the toe cap 140 are affixed to the front medial and lateral end portions 46, 48 of the medial and lateral side portions 38, 40 of the outer shell 12 by thermal bonding, high frequency welding, ultrasonic welding or any combination thereof. In further embodiments, the first and second walls of the rear medial and lateral extensions 150, 152 of the toe cap 140 are affixed to the front medial and lateral end portions 46, 48 of the medial and lateral side portions 38, 40 of the outer shell 12 by using any method known in the art such as stitching, needling, overmolding or any combination thereof.

In another embodiment, glue, a layer of glue or a layer of adhesive may be applied on the inner and outer surfaces of the medial and lateral end portions 46, 48 and/or on the inner surfaces of the first and second medial walls 150F, 150S and first and second lateral walls 152F, 152S of the rear medial and lateral extensions 150, 152 in order to affix the toe cap 140 (rear extensions 150, 152) and outer shell 12 (medial and lateral end portions 46, 48) together. It is understood that a surface treatment may be applied or performed (light sanding) to the inner and outer surfaces of the medial and lateral end portions 46, 48 and/or on the inner surfaces of the first and second medial walls 150F, 150S and first and second lateral walls 152F, 152S in order to increase mechanical or physical adherence between the surfaces.

The rear medial and lateral extensions 150, 152 of the toe cap 140 may be affixed to the front medial and lateral end portions 46, 48 of the medial and lateral side portions 38, 40 of the outer shell 12 by first applying glue, layer(s) of glue or layer(s) of adhesive to bind together the toe cap 140 and the outer shell 12. Then, the front medial and lateral end portions 46, 48 and the first and second walls 150F; 152F, 150S; 152S of the rear medial and lateral extensions 150, 152 extensions are maintained at a temperature between 75° C. and 100° C. for 1 to 5 seconds. Pressure may be applied to the first and second walls 150F; 152F, 150S; 152S of the rear medial and lateral extensions 150, 152 and the front medial and lateral end portions 46, 48 for increasing the bonding effect between the components.

In a further embodiment, as best seen in FIG. 5, the front medial and lateral end portions 46, 48 of the outer shell 12 each have the plurality of apertures 46A, 48A. Again, as indicated above, glue (or a layer of glue or a layer of adhesive) may be applied on the inner and outer surfaces of the medial and lateral end portions 46, 48 and/or on the inner surfaces of the first and second medial walls 150F, 150S and first and second lateral walls 152F, 152S of the rear medial and lateral extensions 150, 152 such that the toe cap 140 (rear extensions 150, 152) is affixed to the outer shell 12 (medial and lateral end portions 46, 48). Because of the presence of the apertures 46A, 48A, glue or adhesive may fill these apertures such that direct bonding may occur between the first and second walls 150F; 152F, 150S; 152S of the rear medial and lateral extensions 150, 152 due to the glue or adhesive occupying the apertures 46A, 48A.

The toe cap 140 may be made of a rigid material such as nylon, polycarbonate materials, polyurethane, thermoplastics, thermosetting resins, reinforced thermoplastics, reinforced thermosetting resins, polyethylene, polypropylene, high density polyethylene or any other suitable material. The toe cap 140 may also be made of a composite material comprising thermoset material, thermoplastic material, carbon fibers and/or fiberglass fibers. For example, the composite material may be a fiber-matrix composite material that comprises a matrix in which fibers are embedded. The matrix may include any suitable polymeric resin, such as a thermosetting polymeric material (e.g., polyester, vinyl ester, vinyl ether, polyurethane, epoxy, cyanate ester, etc.), a thermoplastic polymeric material (e.g., polyethylene, polypropylene, acrylic resin, polyether ether ketone, polyethylene terephthalate, polyvinyl chloride, polymethyl methacrylate, polycarbonate, acrylonitrile butadiene styrene, nylon, polyimide, polysulfone, polyamide-imide, self-reinforcing polyphenylene, etc.), or a hybrid thermosetting-thermoplastic polymeric material. The fibers may be made of any suitable material such as carbon fibers, polymeric fibers such as aramid fibers, boron fibers, glass fibers, ceramic fibers, etc.

Any feature of any embodiment discussed herein may be combined with any feature of any other embodiment discussed herein in some examples of implementation. Various embodiments and examples have been presented for the purpose of describing, but not limiting, the invention. Various modifications and enhancements will become apparent to those of ordinary skill in the art and are within the scope of the invention, which is defined by the appended claims.

The invention claimed is:

1. A skate hoot for receiving a skater's foot, the skate boot comprising:

(i) an outer shell having medial and lateral side portions for facing medial and lateral sides of the skater's foot, the medial and lateral side portions having forwardly projecting front medial and lateral end portions; and (ii) a toe cap for protecting toes of the skater's foot, the toe cap comprising a bottom portion, a toe portion for at least partially surrounding the skater's toes, an upper portion for at least partially overlapping the skater's toes and rear medial and lateral extensions extending rearwardly from the toe portion, the rear medial extension comprising lengthwise overlapping portions first and second medial walls defining a medial hollow space therebetween and the rear lateral extension comprising lengthwise overlapping first and second medial walls lateral walls defining a lateral hollow space therebetween, the front medial end portion of the medial side portion of the outer shell being at least partially received in the medial hollow space defined the first and second medial walls of the rear medial extension of the toe cap and the front lateral end portion of the lateral side portion of the outer shell being at least partially received in the lateral hollow space defined by the first and second lateral walls of the rear lateral extension of the toe cap, for affixing the toe cap to the outer shell.

2. A skate hoot as defined in claim 1, wherein the front medial and lateral end portions of the medial and lateral side portions of the outer shell are glued to inner surfaces of the first and second medial walls of the rear medial extension and inner surfaces of the first and second lateral walls of the rear lateral extension of the toe cap.

3. A skate boot as defined in claim 1, wherein the front medial and lateral end portions of the medial and lateral side portions of the outer shell each have a plurality of apertures and wherein inner surfaces of the first and second walls of the rear medial extension and inner surfaces of the first and second lateral walls of the rear lateral extension of the toe cap are glued to the front medial and lateral end portions for affixing the toe cap to the outer shell.

4. A skate boot as defined in claim 1, wherein the toe cap is made of thermoset material.

5. A skate boot as defined in claim 4, wherein the thermoset material comprises composite carbon or composite fiberglass.

6. A skate boot as defined in claim 1, wherein the front medial and lateral end portions of the medial and lateral side portions of the outer shell each have a plurality of apertures and wherein the first and second medial walls of the rear medial extension and the first and second lateral walls of the rear lateral extension of the toe cap are made of thermoplastic material.

7. A skate boot as defined in claim 6, wherein the first and second medial walls of the rear medial extension and the first and second lateral walls of the rear lateral extension of the toe cap are affixed to the front medial and lateral end portions of the medial and lateral side portions of the outer shell by thermal bonding.

8. A skate boot as defined in claim 6, wherein the thermoplastic material comprises nylon or high density polyethylene and wherein the first and second medial walls of the rear medial extension and first and second lateral walls of the rear lateral extension of the toe cap are affixed to the front medial and lateral end portions of the medial and lateral side portions of the outer shell by high frequency welding.

9. A skate boot as defined in claim 1, further comprising an insole having a bottom surface and an upper surface for at least partially facing a plantar surface of the skater's foot, the insole having a front portion for at least partially facing a bottom portion of the skater's toes.

10. A skate boot as defined in claim 9, wherein the bottom portion of the toe cap at least partially covers a bottom surface of the front portion of the insole.

11. A skate boot as defined in claim 9, wherein the bottom portion of the toe cap is affixed to the bottom surface of the front portion of the insole.

12. A skate boot as defined in claim 9, wherein the bottom portion of the toe cap comprises front, medial and lateral bottom walls extending inwardly from the toe portion and rear medial and lateral extensions of the toe cap and wherein the front, medial and lateral bottom walls are affixed to the bottom surface of the front portion of the insole.

13. A skate boot as defined in claim 1, wherein the first and second medial walls of the rear medial extension are first and second side medial walls, the rear walls and the medial hollow space is surrounded by the top, bottom and first and second side medial walls and wherein the first and second lateral walls of the rear lateral extension are first and second side walls, the rear lateral extension comprising top and bottom lateral walls and the lateral hollow space is surrounded by the top, bottom and first and second side lateral walls.

14. A skate boot as defined in claim 13, wherein the rear medial extension comprises a generally horizontal wall extending between the first and second side medial walls and wherein the rear lateral extension comprises a generally horizontal wall extending between the first and second side lateral walls.

15. A skate boot as defined in claim 1, wherein the rear medial extension comprises top and bottom walls and the medial hollow space is surrounded by the top, bottom and first and second medial walls and wherein the rear lateral extension comprises top and bottom walls and the lateral hollow space is surrounded by the top, bottom and first and second lateral walls.

16. A skate boot as defined in claim 15, wherein the rear medial extension comprises a generally horizontal wall extending between the first and second medial walls and wherein the rear lateral extension comprises a generally horizontal wall extending between the first and second lateral walls.

17. A skate boot as defined in claim 1, further comprising a tongue extending upwardly and rearwardly from the toe cap for covering a forefoot of the skater's foot and wherein the toe cap has a top extension glued or stitched to a distal end portion of the tongue.

18. A skate boot for receiving a skater's foot, the skate boot comprising: (i) an outer shell having medial and lateral side portions for facing medial and lateral sides of the skater's foot, the medial and lateral side portions having front medial and lateral end portions; and (ii) a toe cap for protecting toes of the skater's foot, the toe cap comprising a bottom portion, a toe portion for at least partially surrounding the skater's toes, an upper portion for at least partially overlapping the skater's toes and rear medial and lateral extensions extending rearwardly from the toe portion, the medial end portion of the outer shell being received between lengthwise overlapping first and second medial walls of the rear medial extension of the toe cap, and the lateral end portion of the outer shell being received between lengthwise overlapping first second lateral walls of the rear lateral extension of the toe cap.

* * * * *